US006513188B2

(12) United States Patent
Zahuranec et al.

(10) Patent No.: US 6,513,188 B2
(45) Date of Patent: Feb. 4, 2003

(54) MIXING PUMP FOR CARPET EXTRACTOR

(75) Inventors: Terry L. Zahuranec, North Olmsted, OH (US); Brett Latimer, Mentor, OH (US); Robert A. Salo, Mentor, OH (US); Mark E. Cipolla, Chardon, OH (US); Wallace D. Tiller, Jr., Stow, OH (US); Jeffrey M. Kalman, Cleveland Heights, OH (US); Craig M. Saunders, Rocky River, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/759,827

(22) Filed: Jan. 12, 2001

(65) Prior Publication Data

US 2002/0092115 A1 Jul. 18, 2002

(51) Int. Cl.[7] ..... A47C 9/28
(52) U.S. Cl. ..... 15/320; 15/339; 15/410
(58) Field of Search ..... 15/320, 339, 410

(56) References Cited

U.S. PATENT DOCUMENTS 3,631,558 A 1/1972 Kovacevic et al.
3,939,527 A 2/1976 Jones
3,940,826 A * 3/1976 Phillips et al. ..... 15/320
3,974,541 A * 8/1976 Silvis et al. ..... 15/314
4,156,952 A * 6/1979 Lynch, Jr. ..... 15/320
4,267,617 A 5/1981 Brown et al.
4,558,484 A 12/1985 Groth
4,570,856 A 2/1986 Groth et al.
5,077,863 A 1/1992 Rench
5,392,490 A * 2/1995 Monson ..... 15/320
5,784,755 A 7/1998 Karr et al.
5,937,475 A 8/1999 Kasen et al.
6,247,202 B1 * 6/2001 Lesco et al. ..... 15/320

* cited by examiner

*Primary Examiner*—Chris K. Moore
(74) *Attorney, Agent, or Firm*—Fay, Sharpe, Fagan, Minnich & McKee, LLP

(57) ABSTRACT

A carpet extractor includes a solution distributor, such as a spray bar 90, which delivers cleaning solution to a floor surface. A housing 10 selectively receives a recovery tank 22 for collecting dirty cleaning solution from the floor. A first tank 14 for concentrated cleaning fluid and a second tank 15 for clean water supply cleaning fluid and water to a reciprocating pump 420 through first and second fluid lines 412, 410. The pump includes a piston 428, which reciprocates between first and second ends of a cylindrical bore 430. A fluid line 432 interconnects the first and second fluid lines. As the pump reciprocates, a portion of the water is drawn into the interconnecting line during a downward stroke, where it mixes with the entering cleaning solution. As the pump moves on its upward stroke, the mixture is drawn back into the water line and is pushed onward by the pump toward the spray bar with each successive downward stroke.

17 Claims, 16 Drawing Sheets

MIXING PUMP FOR CARPET EXTRACTOR

BACKGROUND OF THE INVENTION

The present invention relates to the carpet extractor arts. It finds particular application in conjunction with the cleaning of floors and above-floor surfaces, such as upholstery, stairs, and the like, using a cleaning solution.

Carpet extractors of the type which apply a cleaning solution to a floor surface and then recover dirty fluid from the surface are widely used for cleaning carpeted and wooden floors in both industrial and household settings. Generally, a recovery tank is provided on the extractor for storing the recovered fluid. A vacuum source, such as a vacuum pump, is mounted to a base frame of the extractor and applies a vacuum to a nozzle adjacent the floor surface. For ease of manipulating the extractor, the recovery tank may also be mounted to the base.

To increase or regulate the flow of cleaning fluid to the floor surface, a pump may be used to pump the cleaning solution from a cleaning solution tank to the floor surface. To date, such pumps, however, have not been able to pump cleaning solution from two separate sources, such as a concentrated cleaning fluid tank and a water tank, while mixing the two liquids effectively to form a relatively homogeneous dilute cleaning solution.

The present invention provides a new and improved apparatus, which overcomes the above-referenced problems and others, while providing better and more advantageous results.

SUMMARY OF INVENTION

In accordance with one aspect of the present invention, a carpet extractor of the type which applies a cleaning solution to surface is provided. The extractor includes a distributor for delivering the cleaning solution to a surface, a source of a first cleaning fluid, and a source of a second cleaning fluid for mixing with the first cleaning fluid to form the cleaning solution. The extractor further includes a pump, a first fluid line fluidly connected between the source of the first cleaning fluid and a first end of the pump; and a second fluid line fluidly connecting the source of the second cleaning fluid, a second end of the pump, and the distributor. A third fluid line, which interconnects the first and second fluid lines, is located between the first and second sources and the pump. The pump mixes the first and second fluids in the interconnecting line. A fluid release valve is located in the second fluid line between the pump and the distributor. The fluid release valve is selectively operable to allow cleaning solution to flow from the pump toward the distributor. The pump maintains the second line between the pump and the fluid release valve pressurized so that cleaning solution is released when the fluid release valve is opened.

In accordance with another aspect of the present invention, a method for providing a dilute solution is provided. The method includes pumping a dilutant through a first line from a source of the dilutant toward a pump and pumping a concentrated fluid through a second line toward the pump. The method further includes mixing the concentrated fluid with the dilutant to form the dilute solution. The mixing step includes drawing a portion of the dilutant from the second line into an interconnecting line between the first and second lines, drawing a mixture of dilutant and concentrated fluid into the second line, and repeating these steps. A valve is selectively opened to release the mixture to a distributor, the pump maintaining the mixture under pressure so that it is released whenever the valve is opened.

In accordance with another aspect of the present invention, a carpet extractor of the type which applies a cleaning solution to a surface and vacuums dirty cleaning solution from the surface is provided. The extractor includes a housing. A directing handle is operatively connected to the housing. A distributor is located in the housing for delivering the cleaning solution to a surface to be cleaned. A pump, located in the housing, pumps the cleaning solution to the distributor. A selectively operable valve, located in the housing, selectively interrupts the flow of cleaning solution to the distributor. A source of suction is located in the housing for applying a vacuum to the surface to draw dirty cleaning solution from the floor surface. A switching assembly operates the pump, the source of suction, and the valve. The switching assembly is mounted to the directing handle.

In accordance with another aspect of the present invention, a carpet extractor is provided. The extractor includes a base housing. A source of suction is located on one of the base housing and the handle. A brush is mounted on the base housing. A cleaning solution distributor is mounted on the base housing. A directing handle is pivotally mounted to the base housing. The directing handle includes a hand grip at a distal end thereof. The hand grip includes a first control mounted on the hand grip for selectively actuating the source of suction. A second control is mounted on the hand grip for selectively actuating the cleaning solution distributor. A third control is mounted on the hand grip for selectively actuating the brush. All three of the controls can be actuated by the digits of one hand of a user without the user needing to displace that one hand from the hand grip to reach any of the controls.

The many benefits and advantages of the present invention will become apparent to those skilled in the art upon reading and understanding the following detailed specification.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENT

Figure 1:
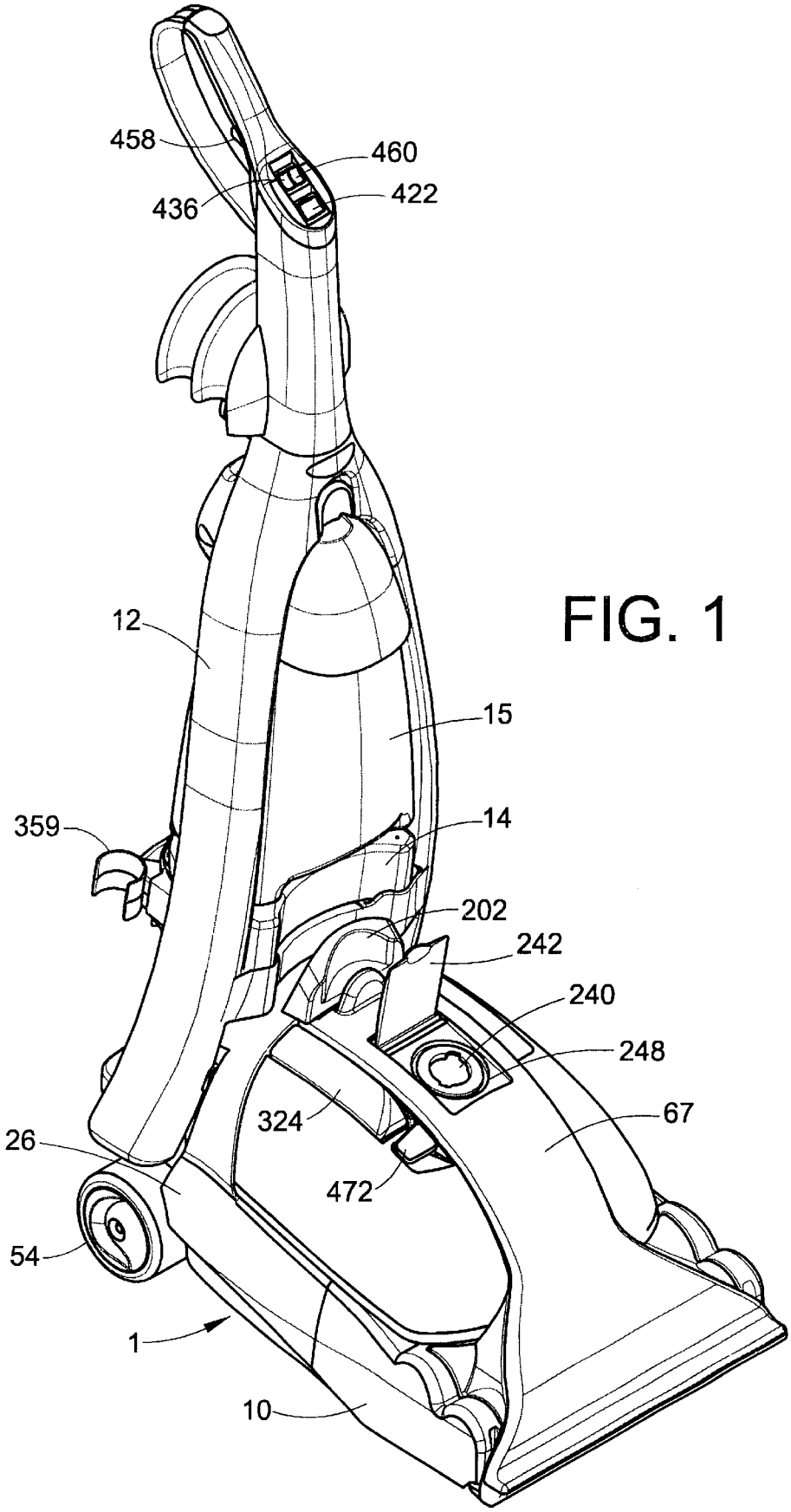
FIG. 1 is a perspective view of an upright carpet extractor according to the present invention.

Referring now to the drawings, wherein the showings are for purposes of illustrating preferred embodiments of the invention only and are not for purposes of limiting the same, FIG. 1 shows an upright carpet extractor. The extractor includes a base assembly I including a base housing 10. A directing handle assembly 12 is pivotally connected to the base housing 10 for manipulating the base assembly over a floor surface to be cleaned. A tank or reservoir 14 for holding a supply of a concentrated cleaning solution is removably supported on the handle assembly 12. A second tank or reservoir 15 holds a supply of fresh water. Liquid from the two tanks is mixed and supplied as a dilute cleaning solution to a floor surface or to an optional hand-held accessory tool 16 (FIG. 2) for remote cleaning. As shown in FIG. 1, the concentrated cleaning fluid tank 14 is seated below the water tank 15, although it will be appreciated that the positions of the two tanks may be reversed. Alternatively, the two tanks may be positioned side by side or replaced by a single tank, which holds a dilute cleaning solution.

With reference to FIGS. 3–7, the base housing 10 includes a lower portion 18, which may be molded as a single piece from plastic or the like. The lower portion defines an upwardly opening socket 20, adjacent a forward end, in which a recovery tank 22 is removably seated, and an upwardly opening motor/fan compartment 24, adjacent a rear end thereof. A motor/fan cover 26 cooperates with the compartment 24 to provide an interior chamber 27, which houses a vacuum source, such as a motor and fan assembly 28, for drawing a vacuum on the recovery tank. Between the compartment 24 and the socket 20 is a further upwardly opening compartment 29, which houses a cleaning solution delivery pump assembly 30. The motor/fan cover is bolted or otherwise connected to the lower portion of the base housing to enclose the motor and fan assembly and the delivery pump.

Figure 3:
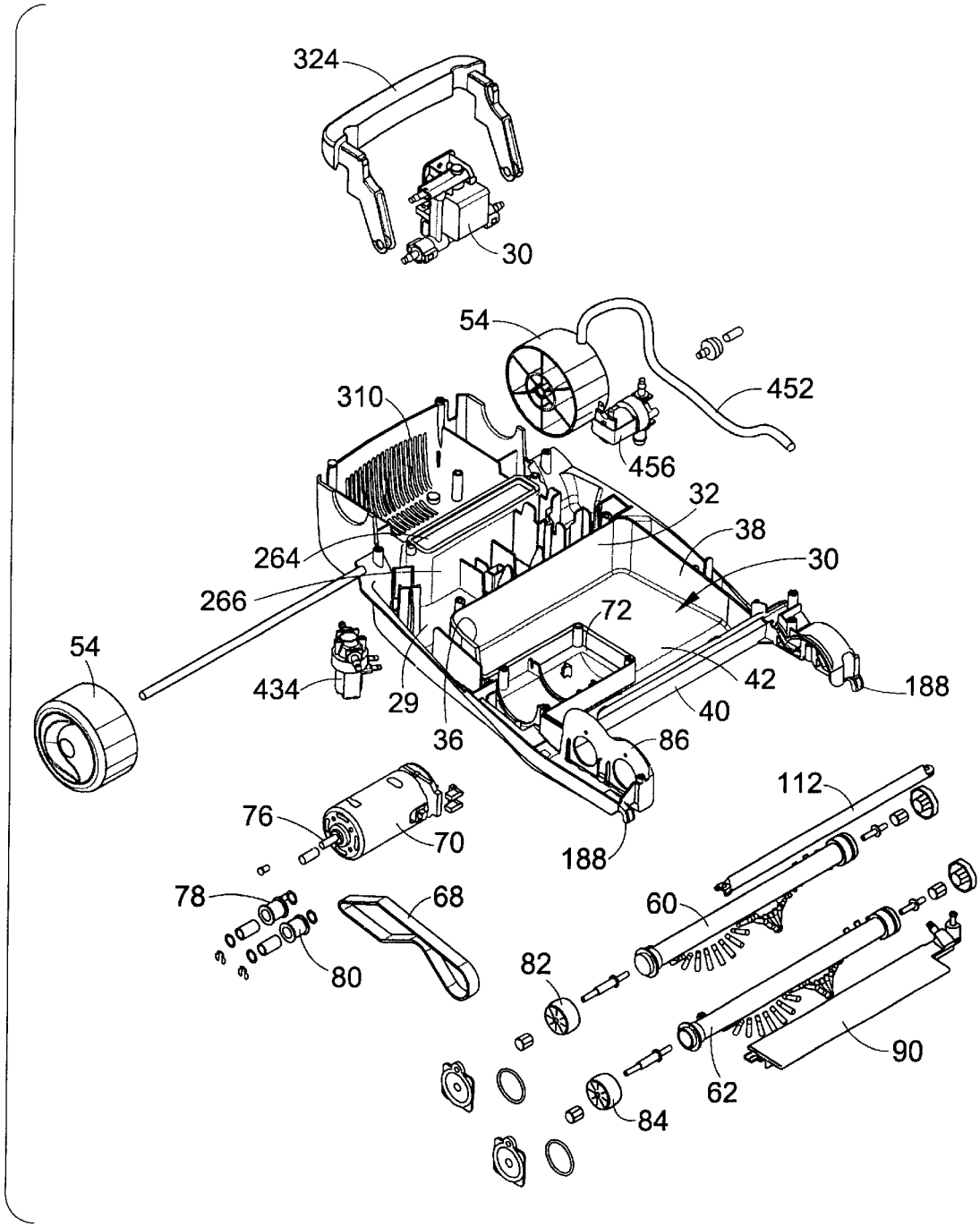
FIG. 3 is an exploded perspective view of the lower portion of the base assembly of the carpet extractor of FIG. 1.

With particular reference to FIG. 3, the recovery tank socket comprises a rear wall 32, which extends upwardly to engage a lower end of a forward wall 34 of the motor/fan cover. Side walls 36, 38, a forward wall 40, which curves forwardly, and a base 42 complete the socket. Laterally spaced wheels 54 are journaled into a rearward end 56 of the base housing 10.

Figure 6:
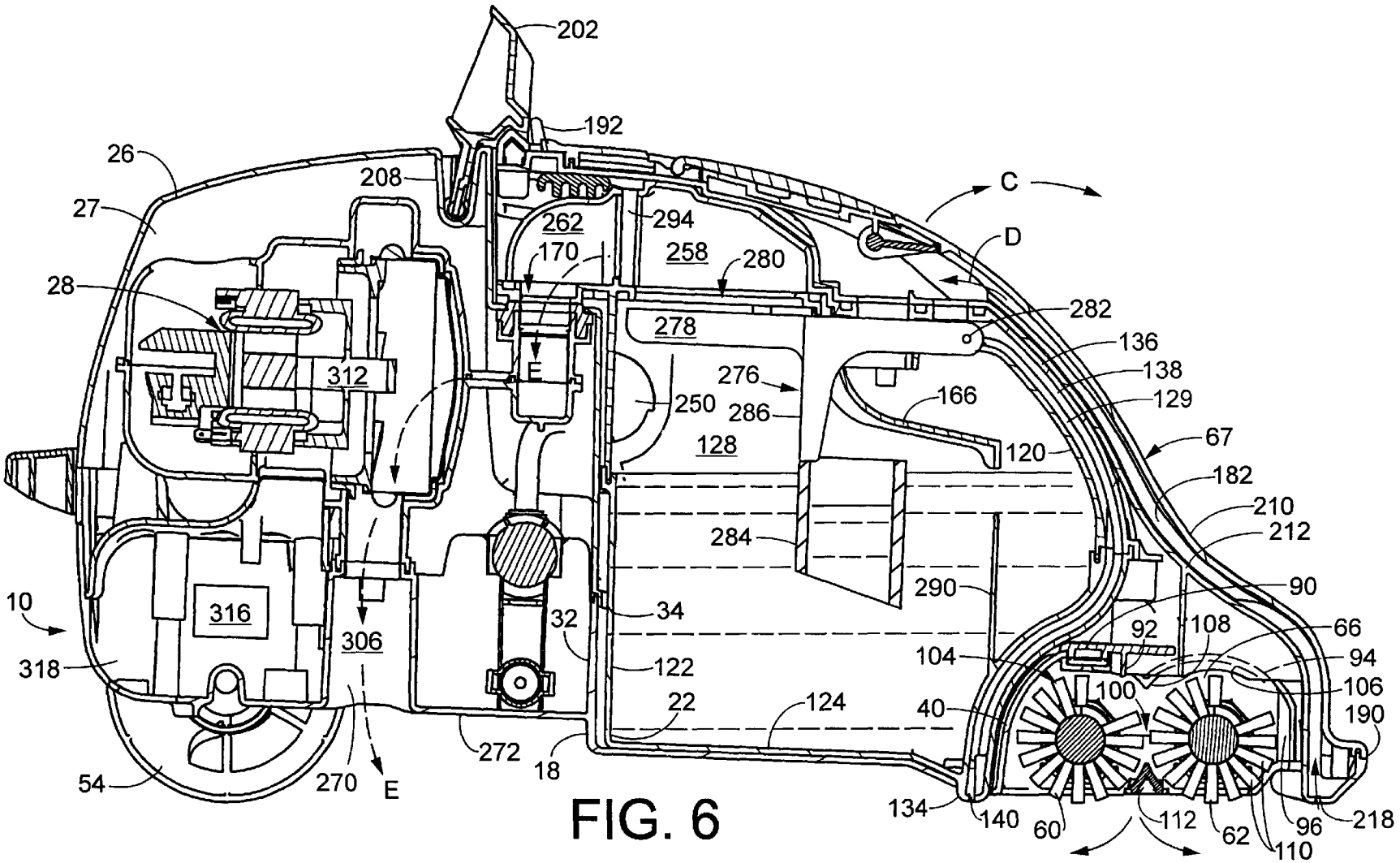
FIG. 6 is an enlarged side sectional view of the extractor base, showing the recovery tank, the float assembly in a closed position and the twin brushrolls.

Two agitators, such as rotatable brushrolls 60, 62, for agitating the floor surface to be cleaned, are mounted adjacent a forward end 64 of the base housing 10 in a downwardly facing integral cavity 66. The cavity may be defined by a lower surface of the lower housing portion 18, or, as will be described in further detail hereinafter, by a nozzle assembly 67. As shown in FIG. 6 the two brushrolls are longitudinally spaced, slightly apart, and in parallel. The brushrolls are counterrotated in the directions shown in FIG. 6 by a single motor-driven belt 68, best shown in FIG. 4, although dual belts are also contemplated. It is also contemplated that a single rotated brushroll or one or more non-motor driven brushes may replace the two mechanically rotated brushrolls.

Figure 7:
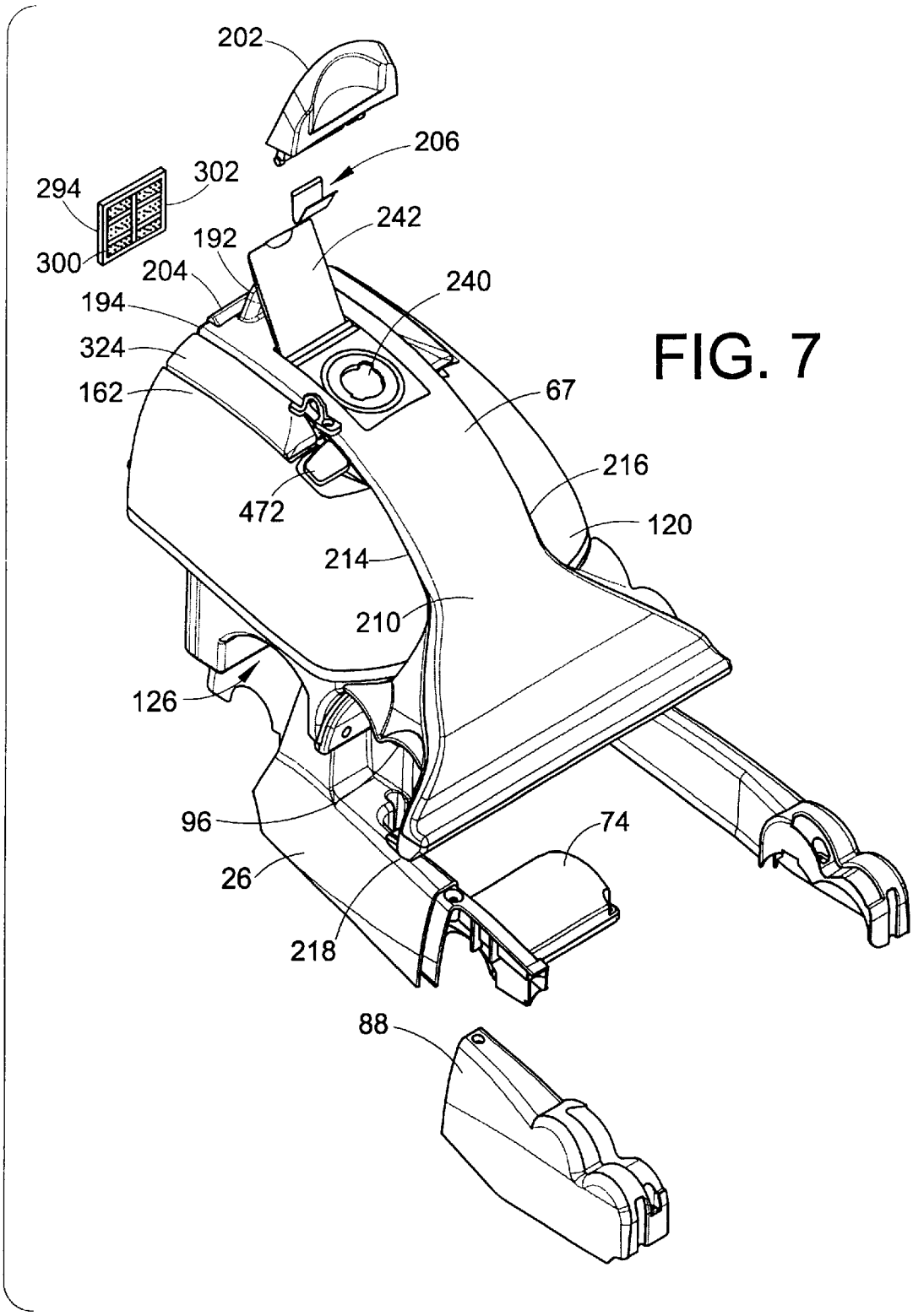
FIG. 7 is an enlarged, exploded perspective view of the recovery tank and fan/motor cover of FIG. 1.

A motor 70 for driving the belt 68 (see FIG. 4) is supported by the lower portion 18 of the base housing in an upwardly facing pocket 72 on the socket base 42, and is covered by a brushroll motor cover 74, shown most clearly in FIG. 7, which forms a part of the motor/fan cover 26. As can be seen, the socket base below the motor 70 curves downwards, below the level of the remainder of the generally planar base, and helps to space the brushrolls a correct distance from the floor surface to be cleaned. The belt 68 is carried by a motor shaft 76 and is vertically spaced by two idler pulleys 78, 80, which rotate under the influence of the belt. The belt passes from the idler pulleys and around drive wheels 82, 84 extending from the brushrolls. The motor 70, belt 68, idler pulleys 78, 80, and brushroll drive wheels 82, 84 are housed outside, and shielded from the brushroll cavity 66 by a wall 86, which is an extension of the socket side wall 36. The wall keeps these mechanical components away from the cleaning liquid within the brushroll cavity and provides for an extended life. The components are covered on their outer sides by a cover member 88, which is removable to provide access for repairs and maintenance.

As shown in FIG. 6, a cleaning solution distributor, such as a manifold, nozzle, or spray bar 90 having spaced openings for releasing the cleaning solution, is mounted within the brushroll cavity 66, adjacent and parallel to the rearward brushroll 60. The spray bar 90 directs cleaning solution onto the floor surface via the adjacent rear brushroll 60. The spray bar is T-shaped, with a downwardly depending wall 92, which deflects any over-spray onto the adjacent brushroll 60.

Optionally, a second distributor 94, mounted within the downwardly facing cavity 66 (or at least with fluid outlets therein) adjacent the forward brushroll 62, is used to deliver the cleaning solution to the second brushroll.

As shown in FIG. 6, a roof 96 of the cavity may be shaped to direct any overflow cleaning solution (i.e., solution which does not fall directly onto either brushroll) downwards, into a gap 100 between the two brushrolls. Specifically, the cavity defines two adjacent tubular cavities 104, 106 with a generally semicircular profile, which meet above the gap 100 in a downwardly projecting v-shaped cusp 108. Thus, any cleaning solution which is projected upward into either tubular cavity tends to run downwards towards the v-shaped edge and on to one or other brushroll or into the gap. The rearward brushroll cavity 104 also provides the forward wall 40 for the recovery tank socket 20 and cooperates with the rear wall 32, sidewalls 36,38 and the brushroll motor cover 74 to hold the recovery tank in position on the shelf without undue movement during carpet cleaning.

It will be appreciated that the gap 100 may be sufficiently narrow that bristles 110 of the two brushrolls overlap each other, or may be more widely spaced so that the cleaning solution could potentially drip from the v-shaped edge 108 directly on to the floor. However, in one embodiment, shown in FIG. 6, a bar 112 having a triangular-shaped cross section is positioned in the gap between the two brushrolls, adjacent the floor. Fluid dripping through the gap is deflected by the bar 112 onto the adjacent brushrolls. This fluid is then worked into the carpet by the brushrolls, providing an enhanced cleaning action, rather than simply dripping on to the carpet.

Figure 5:
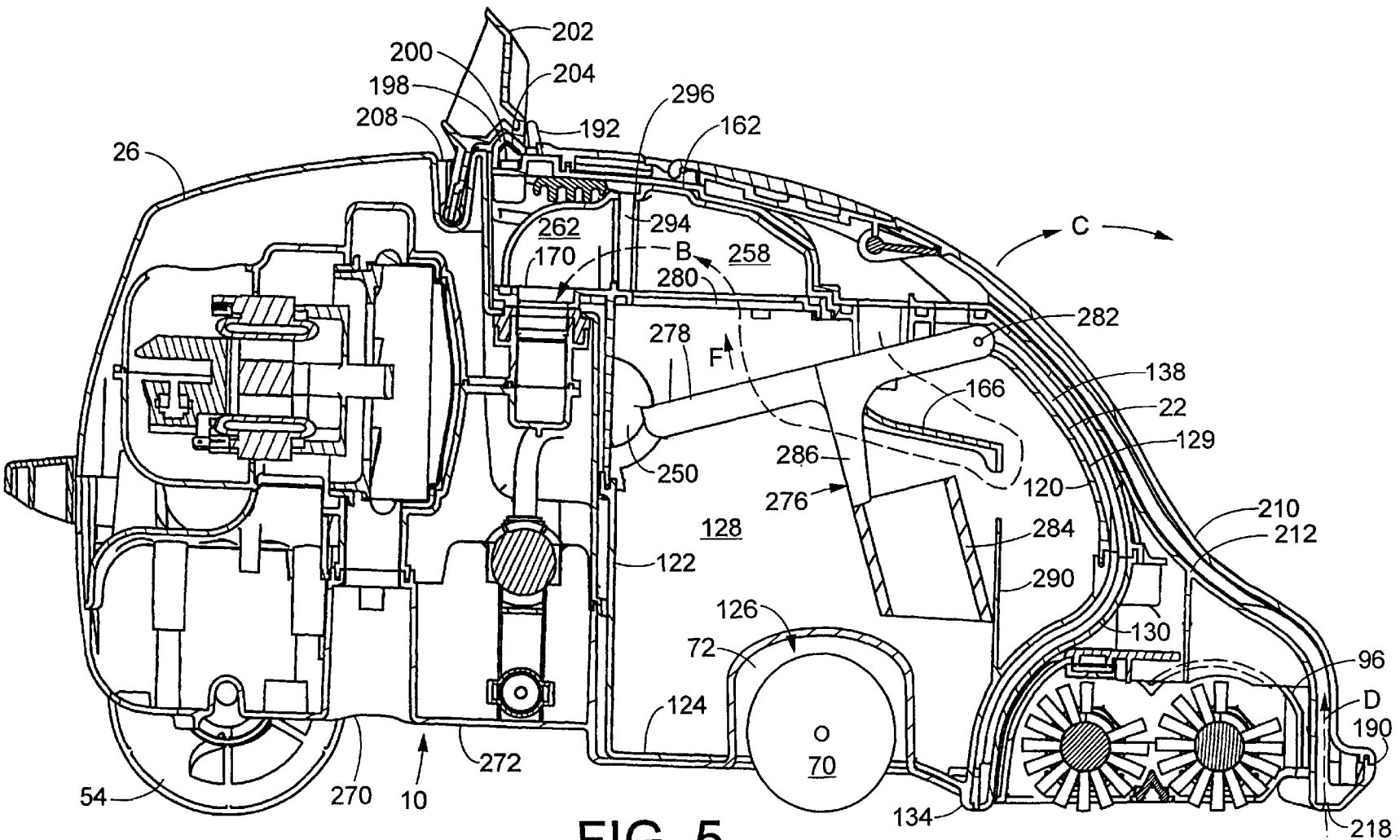
FIG. 5 is an enlarged side sectional view of the extractor base, showing a recovery tank, the float assembly in an open position, and twin brushrolls.

With reference now to FIGS. 5, 6 and 7, the recovery tank 22 includes a curved forward wall 120, which follows the curvature on the socket forward wall, and a rear wall 122, which is seated against the rear wall 32 of the socket. A base wall 124 of the recovery tank defines an indent 126 (FIG. 5), which is shaped to receive the brushroll motor cover. The recovery tank defines an internal chamber 128 for collecting recovered cleaning solution and dirt.

An exterior 129 of the forward wall of the recovery tank defines a depressed zone 130. When the recovery tank is positioned in the socket 20, the depressed zone extends through a slot 132 in the socket base (see FIG. 8), rearward of the brushroll cavity 66, such that a perforated lip 134 at a lower end of the depressed zone is positioned adjacent the floor surface. A nozzle plate 136 cooperates with the depressed zone 130 to form a first suction nozzle flowpath 138 having an elongated inlet slot or nozzle 140 extending laterally across the width of the nozzle plate and an outlet 142, formed in the nozzle plate 136 at an upper end 144 of the flowpath 138 (see FIG. 9). The nozzle cover is adhered to the recovery tank 22 by gluing, sonic welding, or the like, along its peripheral side edges, which sealingly engage adjacent peripheral edges of the depressed zone. Alternatively, the nozzle plate may be removably affixed to the recovery tank by screws, bolts, or other suitable fasteners located adjacent upper and lower ends of the nozzle plate.

The nozzle plate 136 and the depressed zone 130 are formed from a transparent material, such as a conventional thermoplastic, which allows an operator to check that the flowpath 138 is suctioning dirt and cleaning solution effectively and to ensure that the brushrolls 60, 62 are rotating.

Under the vacuum applied by the motor fan assembly 28, the first suction nozzle flowpath 138 carries dirty cleaning solution, together with entrained air, away from the carpet rearward of the two brushrolls. Specifically, dirt and cleaning solution from the floor surface to be cleaned are drawn through the nozzle inlet slot 140 into the first suction nozzle flowpath 138.

Figure 9:
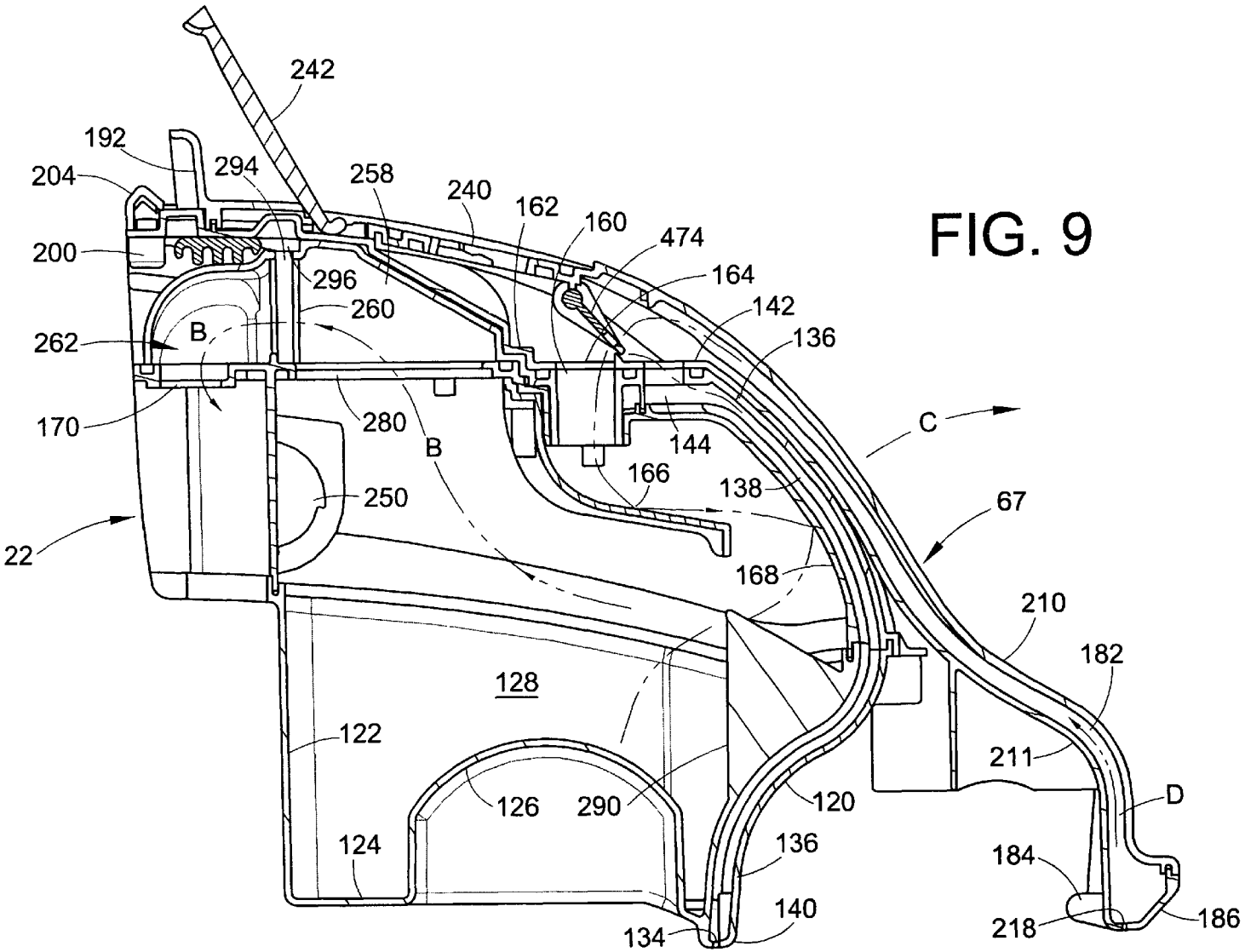
FIG. 9 is an enlarged side sectional view of the recovery tank of FIG. 1 with the nozzle assembly mounted thereon and a door open ready for above floor cleaning.
Figure 10:
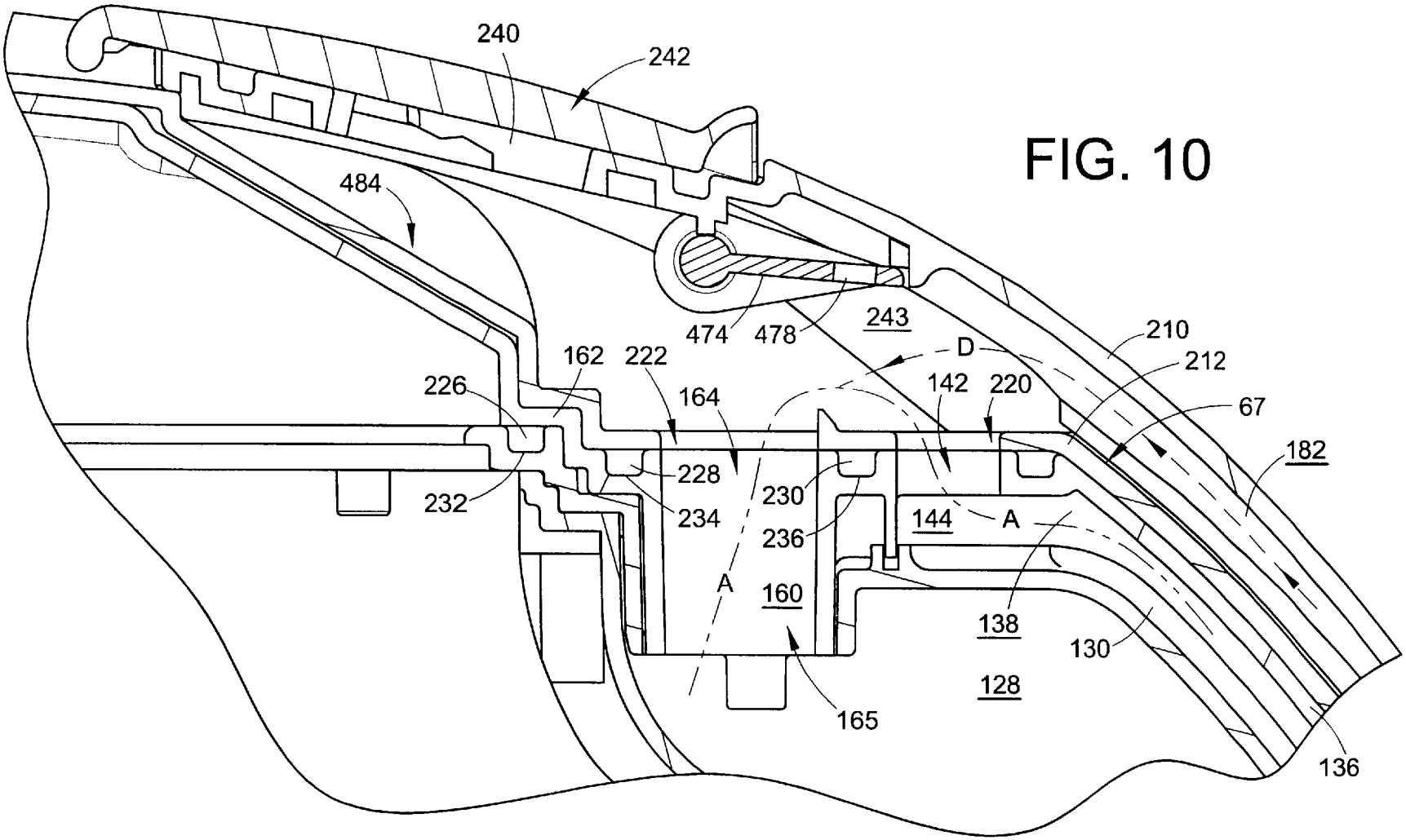
FIG. 10 is a greatly enlarged sectional view of an upper end of the recovery tank of FIG. 9 with a pair of nozzle flowpaths open for carpet cleaning.

With reference now to FIG. 10, a recovery tank inlet slot 160, formed in an upper portion 162 of recovery tank 22, extends vertically into the recovery tank interior chamber 128. The recovery tank slot has an opening or inlet 164 is defined in an upper end of the inlet slot 160 and an outlet 165 at its lower end. The opening 164 is in fluid communication with the nozzle flowpath outlet 142. Arrow A shows the path which the dirty cleaning fluid and air follows as it travels along the first flowpath 138 to the recovery tank. A deflector wall 166, within the recovery tank is curved forwardly away from the inlet slot. Cleaning solution and entrained air strikes the wall and the solution tends to flow downwardly, into the base of the recovery tank. Some of the solution may bounce forwardly off the deflector wall to strike a curved baffle 168, defined by an interior surface of the recovery tank forward wall 120, and from there flows downwardly into the base of the tank. The contact of the fluid with the deflector and baffle helps to separate the cleaning solution from the entrained air. The air is carried through a convoluted pathway through the recovery tank, as indicated by arrow B in FIG. 9. The deflector wall 166 and baffle 168 thus act as an air-fluid separator, helping to separate the solution from the entrained air. The deflector wall 166 directs the recovered cleaning solution and working air through a roughly 90-degree angle, and the baffle then directs the flow downward into the recovery tank where the recovered solution and dirt are collected in the interior chamber 128. The deflector wall prevents liquid from traveling directly toward an air discharge outlet 170 of the recovery tank chamber. Since the air has to make several turns before reaching the outlet, any remaining liquid in the air stream tends to drop out.

Figure 11:
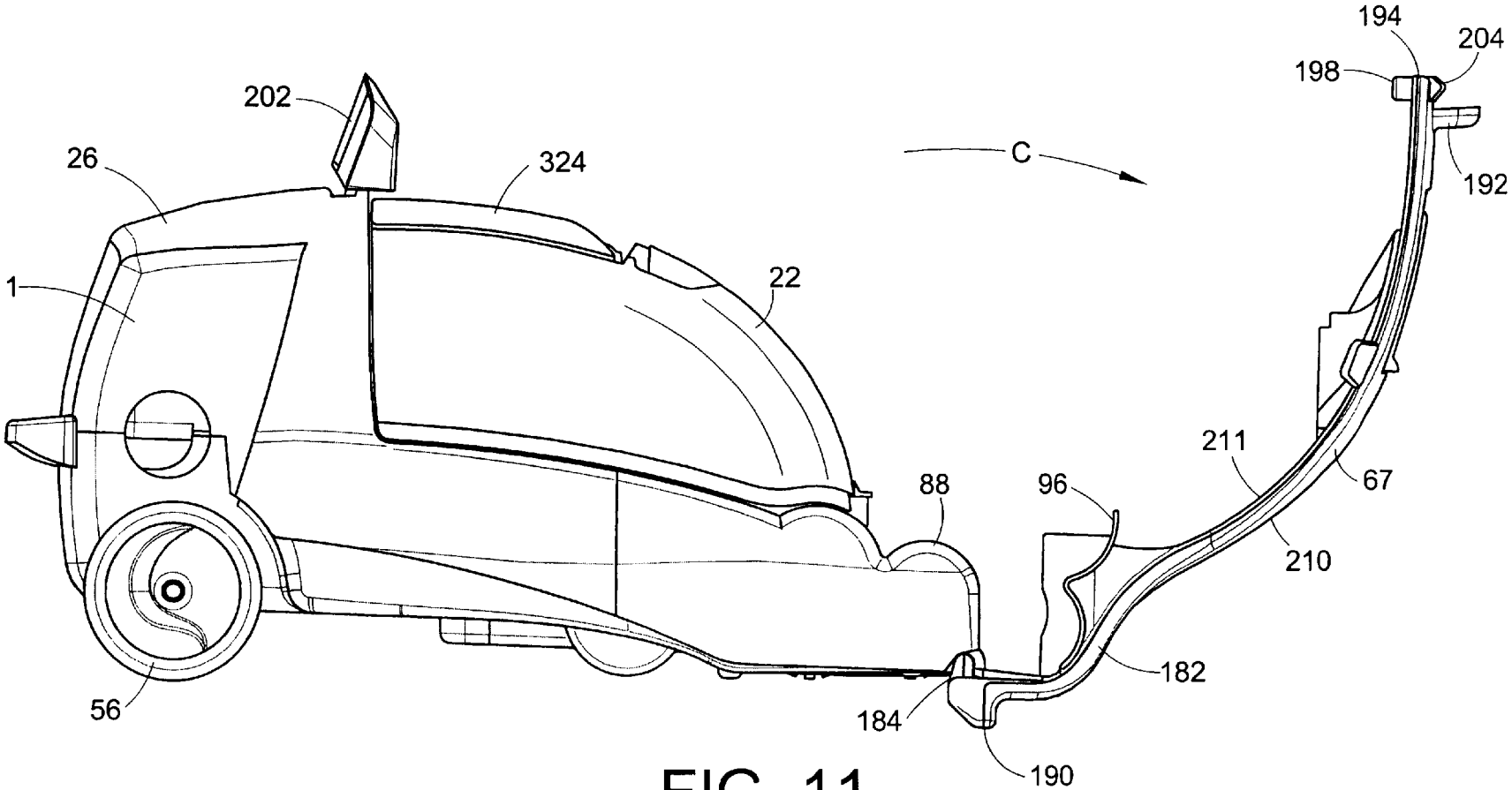
FIG. 11 is an enlarged side view of the base assembly of FIG. 1 with the nozzle assembly pivoted away from the recovery tank to allow removal of the tank.

With reference now to FIG. 11, the nozzle assembly 67 is pivotally mounted to the forward end 64 of the base housing 10 and defines a second suction nozzle flowpath 182 therethrough. Specifically, the nozzle assembly is pivotally mounted by rearward projecting flanges 184, adjacent its lower end 186, to pivot hooks 188 mounted to the exterior forward end 64 of the lower portion 18 of the base housing (see FIG. 8). Prior to floor or above floor cleaning, the nozzle assembly 67 is pivoted to an engaged position, in which it is seated on the recovery tank (see FIGS. 5 and 6). When it is desired to remove the recovery tank from the base for cleaning, the nozzle cover is pivoted in the direction of arrow C, away from the recovery tank, to a disengaged position, shown in FIG. 11. In the disengaged position, the nozzle assembly lifts the base assembly 1 upwardly at the forward end 64, so that the bristles are no longer pressing against the carpet surface. Specifically, a projection 190 on the nozzle assembly faces downwardly in the disengaged position, lifting the base housing 10 upward. In this position, the nozzle assembly 67 may be removed completely from the base assembly by pulling the lower end of the nozzle assembly generally downwardly and away from the base, best achieved by first tipping the base slightly using the directing handle 12. This allows the nozzle assembly to be removed for cleaning.

As is also shown in FIG. 11, the roof 96 of the brushroll cavity 66 is defined by the nozzle assembly 67 and thus pivots away from the brushroll cavity with the nozzle assembly to provide ready access to the brushrolls for cleaning.

A tab or handle 192, which extends upwardly adjacent an upper end 194 of the nozzle assembly 67, is provided for manipulating the nozzle assembly. A projection 198, which projects downwardly from the nozzle assembly, is seated in a recess 200 in the recovery tank, thus correctly positioning the upper end of the nozzle assembly on the recovery tank (see FIG. 6).

A latching member 202, pivotably mounted to the motor/fan cover 26, pivots into engagement with a lip or catch 204 on the upper end 194 of the nozzle assembly. The latching member serves to lock the nozzle assembly 67 to the recovery tank 22 and thereby also locking the recovery tank to the base housing 10. A resilient, V-shaped biasing member 206 (FIG. 3), received rearward of the latch in a slot 208, biases the latching member to a forward, engaging position. To release the latching member from engagement, the latching member is pivoted rearward, allowing the nozzle assembly to be pivoted forwardly, away from the recovery tank.

When it is desired to remove the recovery tank 22 from the base 1 for emptying or the like, the latching member 202 is released by the operator and the tab 192 on the upper end of the nozzle assembly 67 is grasped by the operator. The nozzle assembly is then pivoted in the direction of arrow C away from the recovery tank. The recovery tank can then be removed from the base.

With reference to FIGS. 5, 6, 7 and 9–11, the nozzle assembly 67, like the forward end of the recovery tank 22 and nozzle plate 136, is preferably formed from a transparent plastic or the like. The nozzle assembly may be integrally molded, or may comprise upper and lower members 210, 212 which are sealed along peripheral edges 214, 216 (FIG. 7) to define the second flowpath 182 therebetween. A laterally extending slotted lip or nozzle opening 218 adjacent a lower end of the nozzle assembly is positioned close to the floor surface. Dirty cleaning solution and entrained air sucked from the floor forward of the front brushroll enters the second flowpath through the nozzle opening 218 and travels up the flowpath 182, as indicated by arrow D in FIG. 9.

The second flowpath 182 is also in fluid communication with the recovery tank inlet slot 160, as shown in FIG. 10. Specifically, the lower member 212 of the nozzle assembly defines first and second openings 220, 222. The first opening 220 is positioned directly over the upper opening 142 in the nozzle plate 136 and provides a fluid pathway between the first flowpath 138 and the second flow path 182. The second opening 222 is positioned directly over the recovery tank inlet slot. A first stream of dirty cleaning solution and entrained air from the first flow path 138 enters the second flow path 182 through the first opening 220. The first stream merges with the second stream of air and dirty solution in the second flow path and travels as a single stream through the second opening 222 into the recovery tank inlet slot 160.

As shown in FIG. 10, seals, such as gaskets 226, 228, 230, are provided in suitably positioned cavities 232, 234, 236 in the upper surface 238 of the nozzle plate around the first and second openings 220, 222 to provide a relatively airtight seal between the nozzle plate and the lower member 212 of the nozzle assembly.

An accessory receiving opening 240 in the upper member 210 of the nozzle assembly is closed during floor cleaning by a pivotable door or cover 242 so that all the air and recovered solution entering the upper end 243 of the second nozzle flowpath is directed into the recovery tank chamber 128. The opening 240 is suitably shaped (e.g., with a bayonet-type fitting) to receive a hose connector 244 for the vacuum hose 246 of the above floor tool, as will be described in further detail hereinafter. A gasket 248 around the opening 240 helps to provide an airtight seal between the door and the nozzle assembly.

As best shown in FIG. 9, a cleaning solution discharge opening 250 in a side wall 252 of the recovery tank is used for emptying the interior chamber 128 of collected cleaning solution and dirt. The opening 250 is covered by a cap (not shown) during operation of the extractor.

Figure 8:
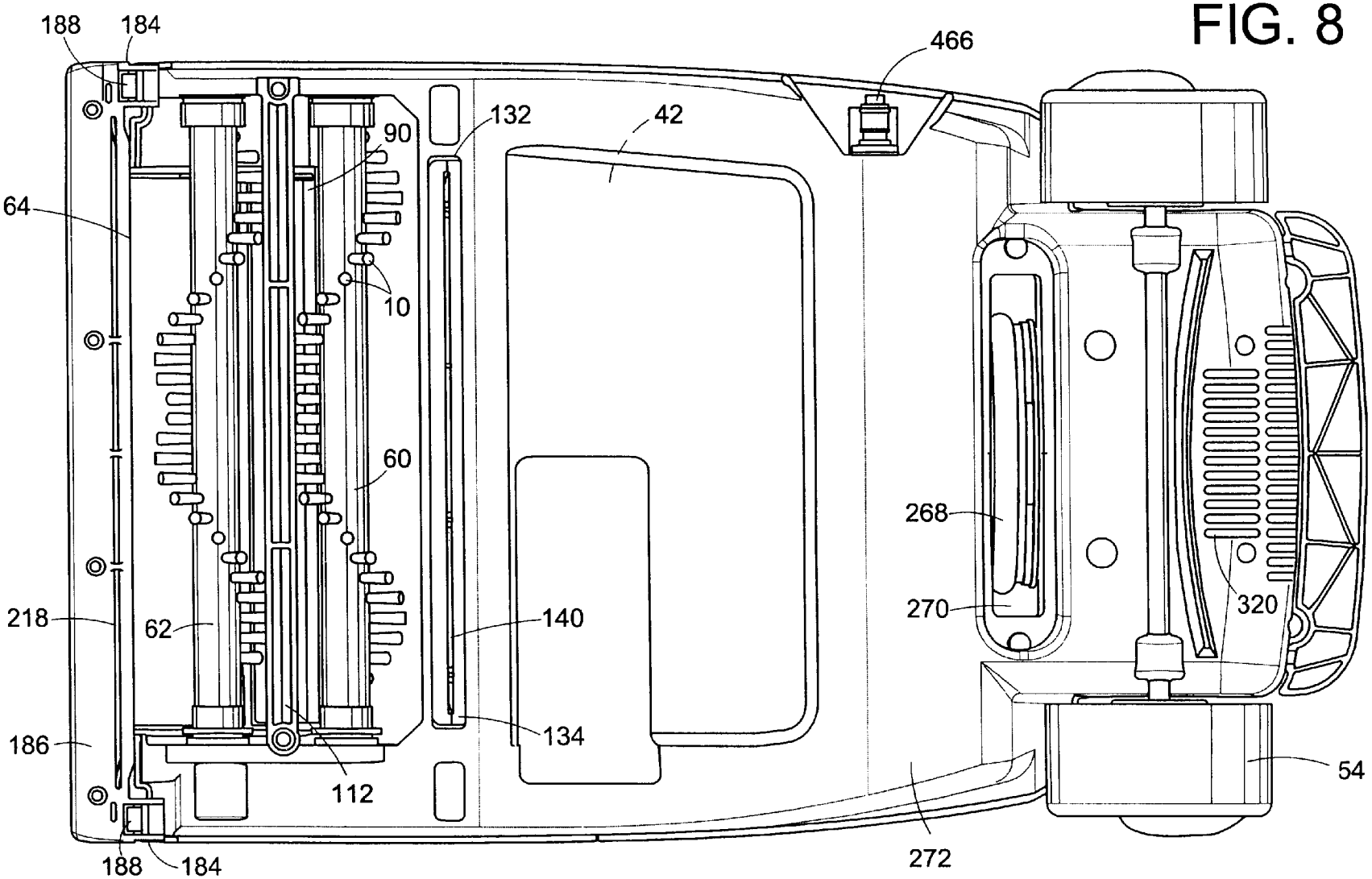
FIG. 8 is an enlarged bottom plan view of the carpet extractor base assembly of FIG. 1.

The air discharge outlet 170 is defined in an upper rearward portion of the recovery tank 22. When the recovery tank is seated in the socket 20, the air discharge outlet is in fluid communication with the motor/fan for transporting the dewatered air out of the recovery tank. Optionally, this opening may also be used for emptying the collected dirty cleaning solution and dirt from the tank in place of or in addition to the opening 250. The upper portion of the recovery tank interior chamber comprises an air separation chamber 258, which is above the level of the inlet slot 160 to the recovery tank. The air separation chamber has a rearward facing outlet 260. The outlet is connected with a downwardly extending outlet slot 262, which projects rearwardly from the recovery tank. The air discharge outlet 170 is positioned at the lower end of the outlet slot 262. The outlet 170 is seated over a corresponding upper inlet or opening 264 in a vertically extending inlet slot 266, adjacent the forward wall 34 of the motor/fan housing cover, which communicates with the interior motor/fan chamber 27. Working air is sucked upward through the recovery tank 22 by the motor and fan assembly into the air separation chamber and is directed downward, through an almost 180-degree turn, into the outlet slot 262. The air follows the path shown by arrow E into the fan 268 and exits the motor/fan chamber 27 though an opening 270 in a lower wall 272 of the extractor base housing (FIGS. 6 and 8).

The positioning of the recovery tank 22 and motor and fan assembly 28 provides a low profile extractor base assembly 1, while maintaining a sizeable capacity for the recovery tank. This allows the base assembly to be wheeled under chairs, beds, and other household furniture or obstructions.

With continued reference to FIGS. 5, 6, and 9, a float assembly 276 is pivotally mounted within the recovery tank 22. The float 276 chokes off the flow of working air through the recovery tank chamber 128 when the reclaimed solution in the recovery tank reaches a predetermined level (see FIG. 6). Specifically, the float includes a flap 278 which closes off a lower entrance 280 to the air separation chamber 258 when the liquid in the recovery tank reaches the predetermined level. The flap 278 is pivotally connected at its forward end to the recovery tank at a pivot point 282 so that it rotates towards the closed position in the direction shown by arrow F as the fluid level rises (see FIG. 5). An inverted float cup 284 is connected to a support member 286, which projects downwardly from about the midpoint of the flap 278. As the liquid level in the recovery tank rises, air is trapped in the float cup and buoys the float cup, and hence the flap, upward. As a result, the flap shuts off the entrance to the air separation chamber rapidly, i.e., moves from an open to the closed position over a narrow change in fluid level, typically of the order of about 1–1.5 cm.

An anti-slosh wall 290 projects vertically upward from the base 124 of the recovery tank and reduces sloshing of the liquid in the tank as the extractor is moved back and forth over the carpet. This helps to stop the float from closing prematurely by maintaining the solution in the tank at a relatively even level. The liquid passes slowly from one side of the wall 290 to the other through restricted openings on either side of the wall (not shown). The float cup 284 rests against the wall when the flap is in the open position (FIG. 5).

As shown in FIGS. 5 and 9, a filter 294 is removably mounted across the air separation chamber outlet. Specifically, the filter is received in a slot 296 formed in the upper wall 162 of the recovery tank, between the air separation chamber 258 and the recovery tank outlet slot 262. The filter filters particles of dirt from the working air.

With reference now to FIG. 7, the filter comprises a sheet 300 of a porous material, such as plastic or foam, which is readily washable or replaceable to prevent the filter from becoming clogged with dirt. For rigidity, the filter sheet is held within a plastic frame 302. Prior to entering the recovery tank outlet slot 262, therefore, the working air passes through the filter 300 as shown by arrow B.

With particular reference to FIG. 6, the base housing defines an exhaust chamber 306 at the base of the motor/fan chamber 27. The working air leaves the motor/fan chamber 27 through the exhaust chamber in the direction of the floor surface through the exit slot 270 defined in the base plate 272.

Louvers 310 (shown in FIG. 3), formed in the base housing 10 provide an air inlet for drawing in cooling air for cooling the fan motor 312. A cooling fan 314, connected to a rear of the motor 312, may be rotated by the motor to circulate air around the fan motor to keep it cool. Optionally, the cooling air is also used to cool a heater 316 (FIG. 6), which is used to heat the cleaning solution on its way from the pump 30 to the manifold 90. In this embodiment, the heater 316 is mounted in a chamber 318 located beneath the motor/fan assembly 28. The cooling air passes into the chamber and is exhausted via louvers 320 in the base plate 272 (FIG. 8).

With particular reference to FIGS. 3 and 7, the recovery tank 22 includes a U-shaped carrying handle 324, which is movable between a storage position (shown in FIG. 7), in which the recovery tank handle lies flat beneath the nozzle assembly, and a carrying position, in which the recovery tank can be carried away from the base housing for emptying. In the storage position, the handle lies flat adjacent the top 162 of the recovery tank to maintain the sleek, low profile of the base assembly 1.

Figure 12:
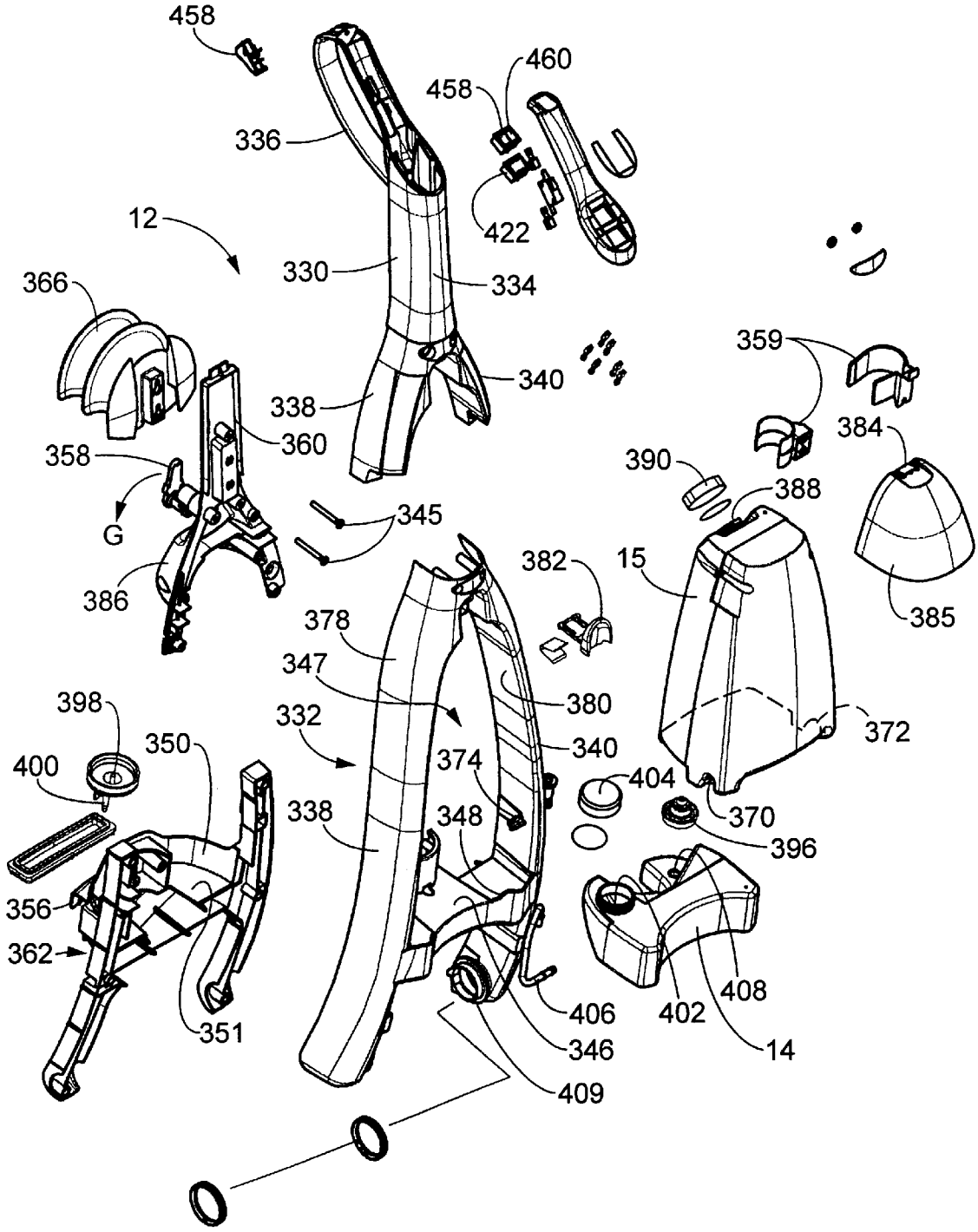
FIG. 12 is a an exploded perspective view of a directing handle and clean water and cleaning fluid tanks of FIG. 1.
Figure 13:
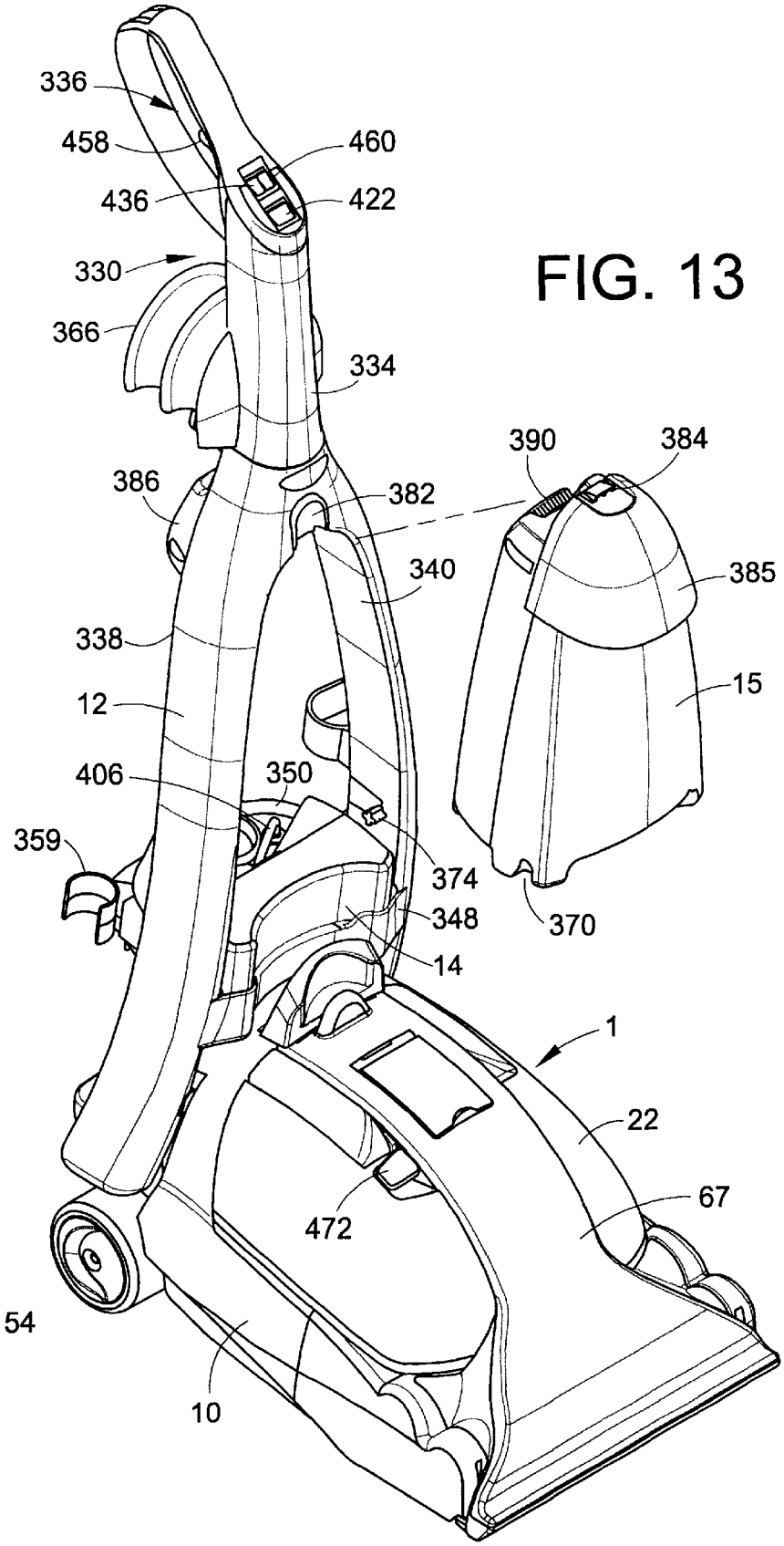
FIG. 13 is a perspective view of the extractor of FIG. 1 with the clean water tank exploded away.
Figure 14:
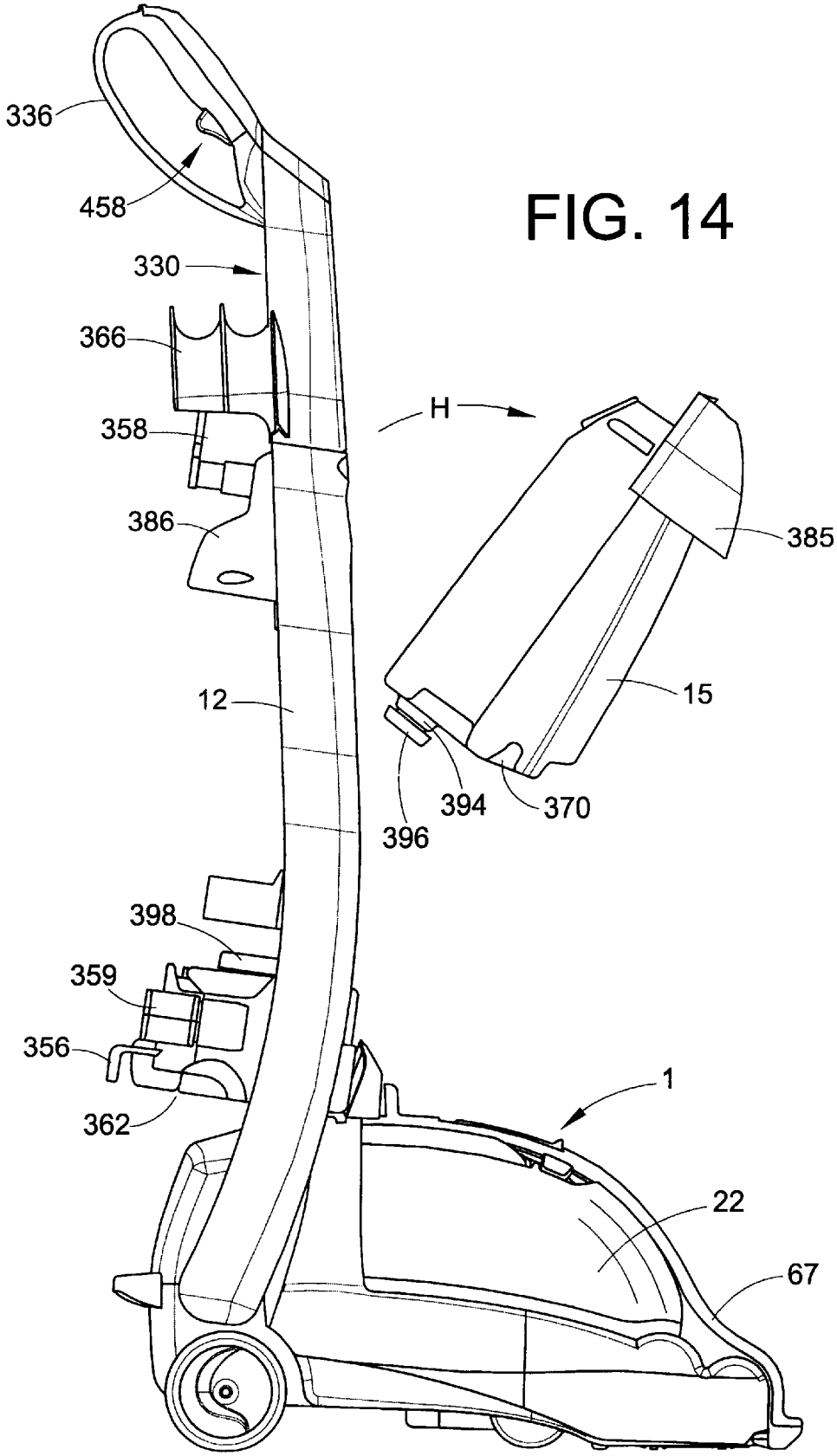
FIG. 14 is a side elevational view of the extractor of FIG. 1 with the clean water tank exploded away and pivoted as it would be during removal.

With reference now to FIGS. 12–14, the directing handle assembly 12 includes an upper handle portion 330 and a lower handle portion 332. The upper handle portion is wishbone-shaped with a central member 334, which defines a hand grip 336 at its upper end, and two splayed legs 338, 340 which are bolted or otherwise attached to corresponding legs 342, 344 on the lower handle portion 332. The two pairs of legs 338, 342 and 340, 344 thus form two splayed leg members, which meet at their upper ends. The directing handle assembly is completed by fixedly attaching the upper handle portion to the lower handle portion with bolts 345, or screws, pins, or other suitable fasteners. A shelf 346 extends horizontally across the generally triangular opening 347 between the two legs 342, 344 to give the lower handle portion 332 a generally A-shaped configuration. The shelf 346 supports the concentrated cleaning solution tank 14 thereon. The shelf has a raised lip 348 at a forward end and a higher lip or wall 350 at a rearward end to retain the tank 14 in position on the shelf. Projecting rearward of the rear wall 350 is a hook 356 for winding the electrical cord for the extractor therearound. A further hook 358 holds an upper end of the electrical cord coil. The hook 358 is rotatable, as shown by arrows G, to allow the cord to drop freely from the hook without unwinding.

The lower and upper handle portions may be used to store tools when not in use. For example, one or more receptacles 359 (see FIG. 1) may be provided on the handle for receiving tools.

The wishbone shape of the handle allows for a rigid construction, while minimizing the use of materials. Specifically, the legs 338,340,342,344 are generally semi-cylindrical and open toward the rear. The rear openings may be covered or partially covered by removable plates 360, 362 to encase electrical wiring and fluid supply tubes. Extra rigidity may be provided by horizontal support members (not shown), vertically spaced down each of the legs. A vacuum hose support 366 is mounted to the rear of the central member 330 or elsewhere on the handle. The vacuum hose 246 for the accessory tool is wound around the support 366 when not in use.

The fresh water supply tank 15 is indented, adjacent a lower end, to define two hook-shaped indented regions 370, 372, one on either side of the tank. Two corresponding projections 374 extend inwardly from upper portions 378, 380 of the legs 342, 344 and have a cross-shaped cross section. The projections 374 are received within the indented regions 370, 372 of the fresh water tank. The fresh water tank pivots forwardly around the two projections in the direction of arrow H for removal from the handle assembly (FIG. 14). It will be appreciated that alternative pivotal corresponding mounting members could be formed on the tank 15 and leg members. For example, projections similar to projections 374 could be formed on the tank with corresponding projection receiving members on the handle legs.

As can be seen from FIG. 1, the tank 15, depending on its size, may project forward and/or rearward of the two leg members, allowing the weight of the tank to be centered between the leg members or in another suitable operating position.

During cleaning a barrier member or latch 382, mounted to the lower handle portion 332 (or to the upper handle portion 330) adjacent an upper end of the cleaning solution tank 15, engages a catch 384 or depression, or otherwise secures the forward face of the tank 15 against falling forwardly off the handle assembly. As shown in FIG. 12, the catch is optionally formed in a separate curved retaining wall 385 which slots on to the front of the clean water tank.

A curved retaining member 386 on plate 360 extends rearward from the upper handle portion to support a rear face of the tank 15.

When it is desired to remove the clean water tank 15 for refilling, the latch 382 is pivoted to a disengaged position. The water tank is then pivoted forwardly to a position in which it can be lifted upwardly and away from the extractor. The water tank is refilled with water (or emptied) via a fill opening 388 near an upper end of the tank, which is then closed with a cap 390. The water may be tap water, either hot or cold. Optionally, chemical additives may be added to the water, such as a concentrated anti-soiling agent, which is applied to the carpet after cleaning. It is also contemplated that additional soap or precleaning agents may be added to the clean water tank, on occasion, for more concentrated cleaning of heavily soiled areas of carpet.

With particular reference to FIG. 14, a water outlet 394, at the base of the water supply tank 15, supplies clean water from the tank. A check valve 396 closes off the outlet 394 during transport of the tank 15. A reservoir valve actuator 398 mounted to the shelf opens the check valve 396 when the tank is seated on the handle assembly, allowing clean water to enter a water supply line 400.

As shown in FIG. 12, the cleaning fluid tank 14 is seated on the shelf 346 and can be removed from the handle 12, after first removing the clean water tank, for periodic refilling with concentrated cleaning fluid, such as a soap solution. For this purpose, a fill opening 402 is provided in the top of the tank, which is then closed with a cap 404. Alternatively, the concentrated cleaning fluid tank 14 may be refilled in situ, after the clean water tank has been removed. The concentrated cleaning fluid tank 14 is smaller than the fresh water tank 15 and is preferably refilled about once for every five or six refills of the clean water tank. The respective sizes of the two tanks is partially dependent on the desired concentration of the dilute cleaning solution and the ratio of concentrated cleaning solution to clean water which is used to achieve this. For example, if the ratio of concentrated cleaning solution to water is from about 1:128 to 4:128, a suitably sized concentrated cleaning fluid tank is about 0.6 liters and about 3.8 liters for the clean water tank.

A pickup tube 406 is received in an upper opening 408 of the tank 14, through which the cleaning solution is withdrawn from the tank. The concentrated fluid tank 14 is thus free of openings on its sides or base through which cleaning fluid could leak on to the carpet.

As shown in FIG. 14, the directing handle assembly 12 is pivotally connected to the base housing 10 for movement between an upright position and a working position. Specifically, the first and second splayed leg members include trunnions 409, adjacent their lower ends, which are pivotally mounted to the base housing 10 (FIG. 12). As is evident from FIG. 1, the recovery tank 22 is removable from the base assembly 1 even in the upright position of the directing handle assembly 12, facilitating emptying of the recovery tank 22. In other words, the recovery tank can be lifted vertically by its carrying handle and clears the cleaning fluid tank 14, clean water tank 15, and the directing handle assembly 12. Similarly, the clean water tank 15 and the cleaning fluid tank 14 may be removed when the recovery tank is mounted on the base housing 10, even when the directing handle is in the upright position.

Figure 15:
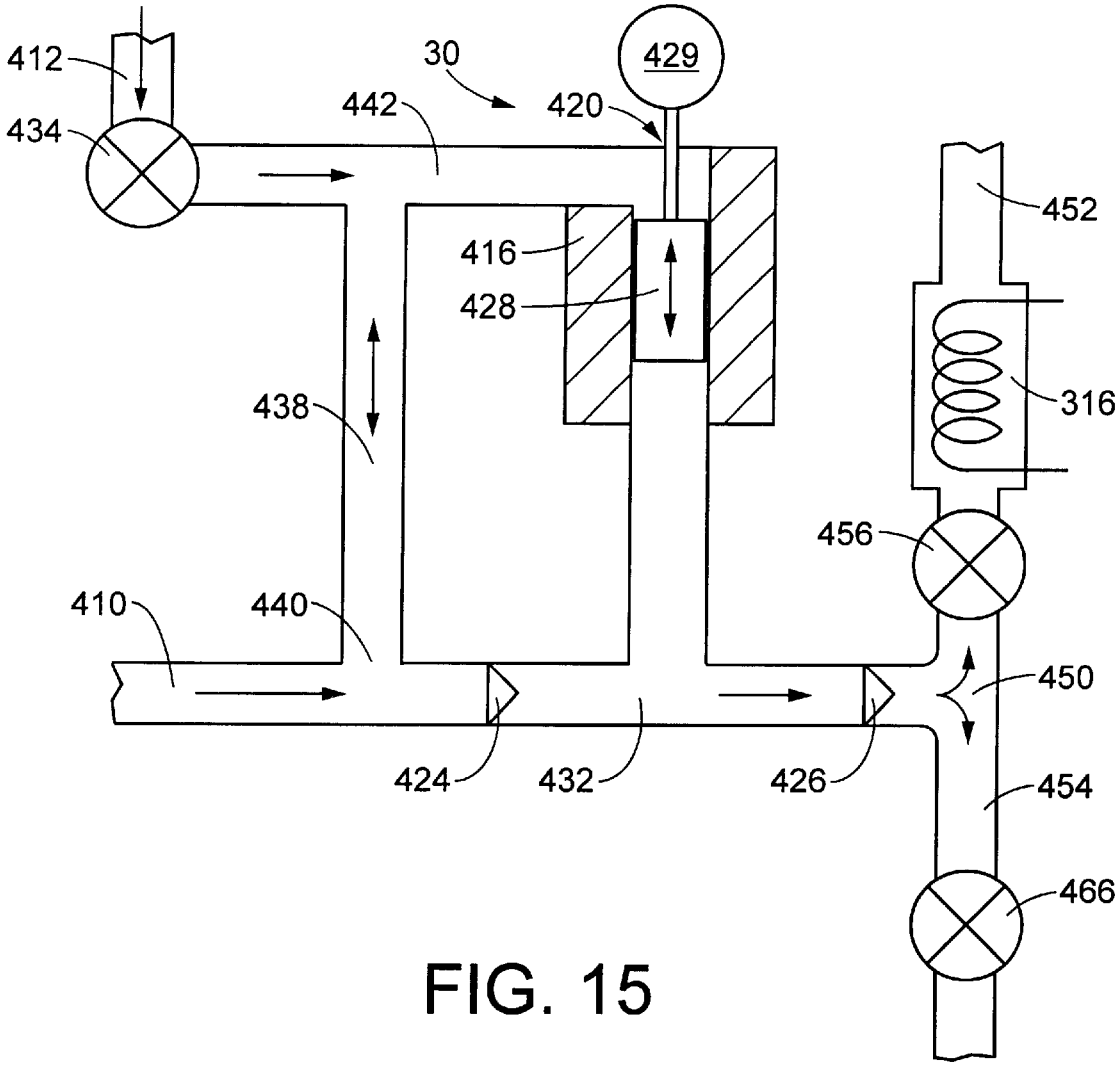
FIG. 15 is a schematic view of a cleaning solution distribution pump assembly of the carpet extraction of FIG. 1.

With reference now to FIG. 15, fluid pathways 410 and 412 (which include the supply line 400 and dip tube 406, respectively) connect the clean water tank and concentrated cleaning fluid tank outlets 394, 408, respectively, with the pump assembly 30 in the base housing. The pump assembly 30 provides pressurized dilute cleaning solution for the manifold 90 or accessory tool 16. The pump assembly includes a housing 416 with a vibrating piston pump 420 mounted therein. Such pumps may be obtained from Siebe Corp (Invensys) of Lamora, Italy. The pump is operated by a master switch 422 (FIG. 13), mounted on the directing handle, which also operates the motor/fan assembly 28. Preferably, the pump 420 is run continuously, whenever the extractor is in operation, to maintain dilute cleaning solution under pressure, ready for use when needed. The first fluid pathway 410 carries the fresh water to the pump. The direction of flow in the fluid pathway 410 is maintained by first and second one way check valves 424, 426.

The pump includes a piston 428, driven by a motor 429. The piston 428 is mounted for reciprocating movement in a vertically extending piston bore 430 connected with a portion 432 of the first fluid pathway 410 between the two check valves. As the piston moves upward, the first check valve 424 opens and water is drawn into the portion 432 of the first pathway. When the piston moves downward, the first check valve closes and the second valve 426 opens, allowing the pressurized fluid to exit the inter-valve portion 432.

The second fluid pathway 412 (for the concentrated cleaning fluid) is connected with the first fluid pathway 410 upstream of the first check valve 424. When it is desired to add concentrated cleaning fluid to the water to form a dilute cleaning solution, an electrically operated valve, such as a solenoid valve 434, in the second fluid line is opened by operation of a switch 436 on the directing handle. The valve 434 may alternatively be a variable valve which adjusts the flow of cleaning fluid therethrough over a range of flow rates. Or, an additional variable flow restrictor may be located in the fluid line 412, either upstream or downstream of the valve 434.

When the valve 434 is open, the concentrated cleaning fluid is sucked by the pump into a portion 438 of the second fluid pathway 412, between the solenoid valve 434 and a T-connection 440 with the first fluid pathway 410. It will be appreciated that the extractor can be run without the use of concentrated cleaning fluid by closing the valve 434. This allows, for example, rinsing of a floor surface with clean water to remove remaining dilute cleaning solution therefrom.

Figure 4:
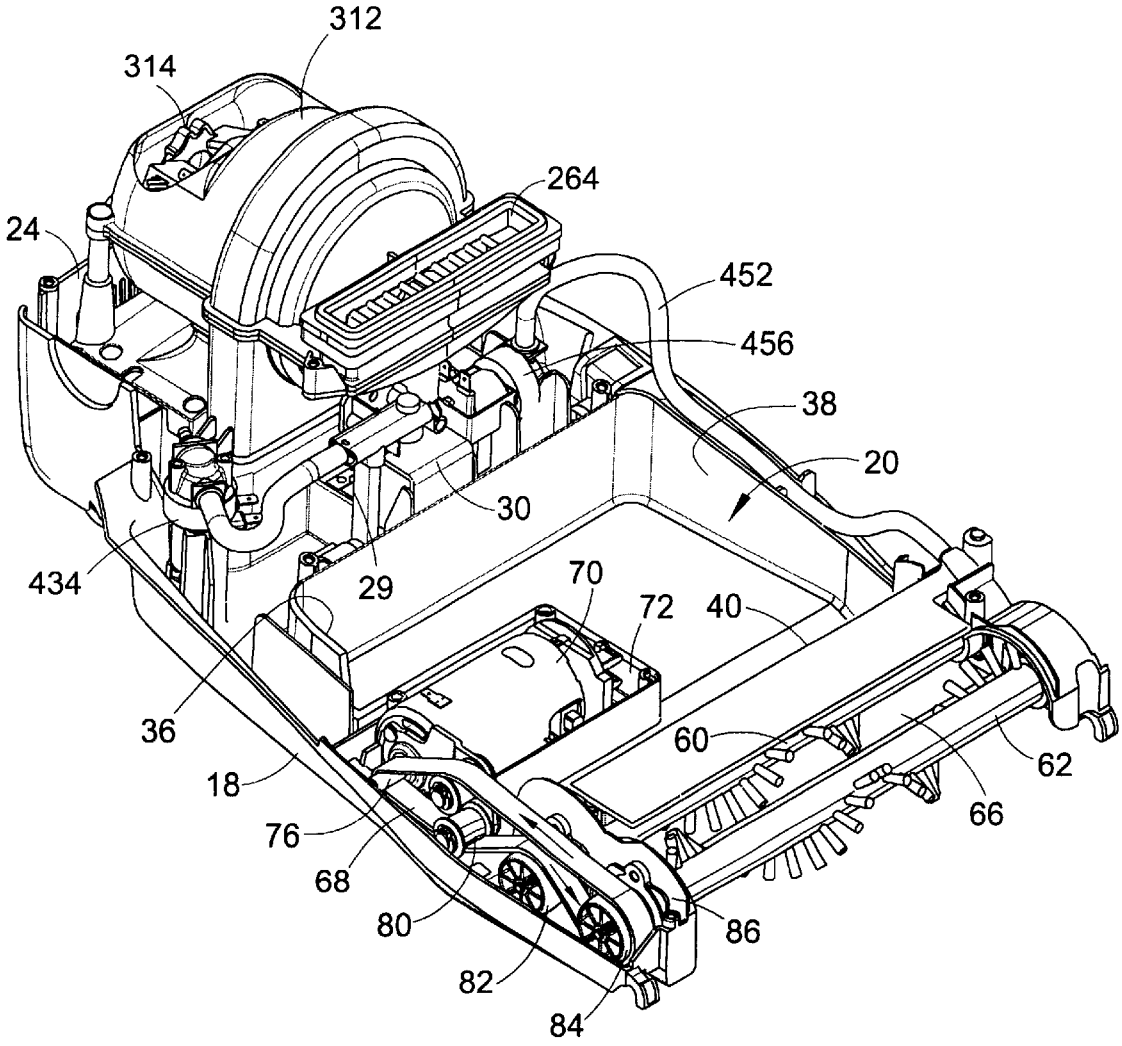
FIG. 4 is a perspective view of a lower portion of the carpet extractor base of FIG. 1, showing a fan/motor assembly, a cleaning fluid pump and a brushroll motor.

As shown in FIG. 4, the solenoid valve and pump assembly are readily accessed for repairs and maintenance by removing the motor/fan cover 26.

In a preferred embodiment, the pump 420 is used to begin mixing the concentrated cleaning fluid with the water in the section 438. A fluid line 442 connects the upper end of the piston tube 430 and the section 438 of the second pathway 412. When the piston 428 moves upward, concentrated cleaning fluid is pushed towards the T-connection and enters the water line 410. As the piston moves downward, more cleaning fluid is drawn into the section 438. However, the solenoid valve restricts the rate of flow of the concentrated cleaning fluid into the section 438 creating a suction, which causes water to flow into the section 438 from the water line and mix with the incoming cleaning fluid. This action helps to mix the concentrated cleaning fluid and water to provide a relatively homogeneous mixture for the dilute cleaning solution as it exits the second check valve.

It is to be appreciated that other pumping or mixing systems may be used to mix and/or pump the cleaning solution. For example, the cleaning fluid and water may be mixed first in a mixing valve and then fed as a dilute solution to a pump. Or, the pump may be eliminated and a gravity feed system used to carry the concentrated cleaning fluid and water to a mixing valve and thereafter to the manifold 90. In such a case, a separate pump may be used for the spray attachment and may be operated only as needed to pressurize the solution.

The dilute cleaning solution (or water, if no concentrated cleaning fluid is being used) passes from the second check valve 426 to a T-shaped connector 450. A first outlet from the T-shaped connector 450 is connected with a first fluid line 452, which carries the cleaning solution to the manifold 90. A second outlet from the T-shaped connector 450 is connected with a second fluid line 454, which carries the cleaning solution to the optional attachment tool 16. When it is desired to spray cleaning solution on to the carpet or other floor surface being cleaned, a solenoid valve 456 in the fluid line 452 is opened by operating a switch or trigger 458 on the directing handle 12 (FIG. 13). A further switch 460 on the handle operates the brushroll motor. Thus the major operating components may all be electrically controlled from the directing handle, either by electrical wires carried through the handle, or by radio telemetry.

The pump assembly 30 maintains the dilute cleaning solution under pressure so that the dilute cleaning solution, pumped by the pump, is sprayed out of the apertures in the manifold 90 and on to the brushroll(s) whenever the solenoid valve 456 is open.

A similar solenoid valve may be used for the hand held accessory tool 16. More preferably, a solution supply hose 462 for the accessory is fitted with a valve actuator 464 (FIG. 2), which opens a check valve 466 in the second line 454 when connected thereto.

Optionally, a heater 316, as previously described, heats the water in the fluid line 452. The heater may be an in-line heater, heating block, heat exchanger, or any other convenient heating system.

With reference to FIG. 3, the solution supply hose 462 of the accessory tool 16 delivers cleaning solution to a remote distributor 468. When it is desired to convert the extractor from the floor cleaning to a remote cleaning mode for cleaning upholstery, stairs, and the like, the brushroll motor 70 is deenergized by tripping the switch 460. The solution supply hose 462 for the accessory is connected with the check valve 468. The cover 242 is pivoted away from the opening 240 in the nozzle assembly 67 and the connector 244 of the vacuum hose for the accessory tool is connected to the bayonet fitting on the nozzle assembly.

The vacuum is then directed towards the vacuum hose 246 to draw a vacuum on a nozzle inlet 470 on the accessory tool. For this purpose, a toggle switch 472 (FIG. 1) on the recovery tank is pivoted to change the flow from the floor nozzle inlets 140, 218 to the accessory tool nozzle 470. The toggle switch 472 moves a flap valve 474, which simultaneously closes off the first and second flow paths 138, 182 (FIGS. 10 and 16) to a great extent. The flap valve 474 is pivotally mounted to the upper member 210 of the nozzle assembly such that it is positioned within the second suction nozzle flowpath 182 between the first and second openings 220, 222 in the lower member. The flap valve pivots from the open position shown in FIG. 10 (floor cleaning) to the closed position shown in FIGS. 9 and 16 (above-floor cleaning). In the closed position, the flap valve engages a sealing member 476, which projects into the second suction nozzle flowpath 182, thereby shutting off, or substantially shutting off both the first suction nozzle flowpath and the second suction nozzle flowpath.

Figure 16:
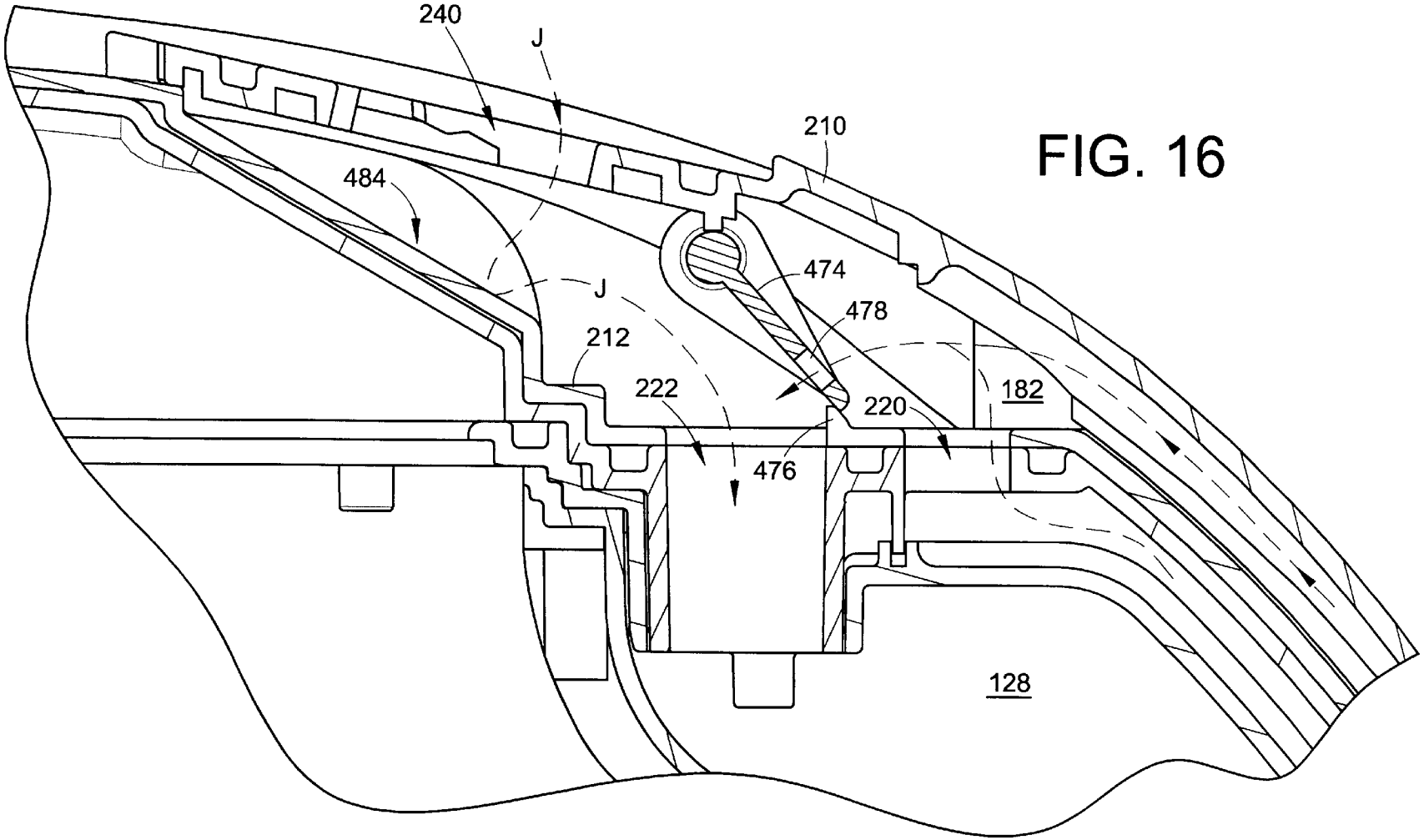
FIG. 16 is a greatly enlarged sectional view of the upper end of the recovery tank as in FIG. 10, with the nozzle flowpaths closed by a flap valve for above floor cleaning.

As shown in FIGS. 5, 10, and 16, the flap valve 474 has a small aperture 478 therethrough, which applies a portion of the vacuum to the first and second suction nozzle flowpaths 138, 182 when the flap valve 474 is in the closed position. This low suction, approximately 20% of normal suction, serves to reduce the chance for drips of the dirty cleaning fluid to travel back down the suction nozzle flowpaths to the respective nozzle inlets 140, 218 when the extractor has first been used for floor cleaning. Also, any drips from the spray bar 90 can also be removed from the floor surface on which the extractor is located. The aperture is sized, however, such that the majority of the suction is applied to the above floor tool 16 when the flap valve is in the closed position.

Figure 2:
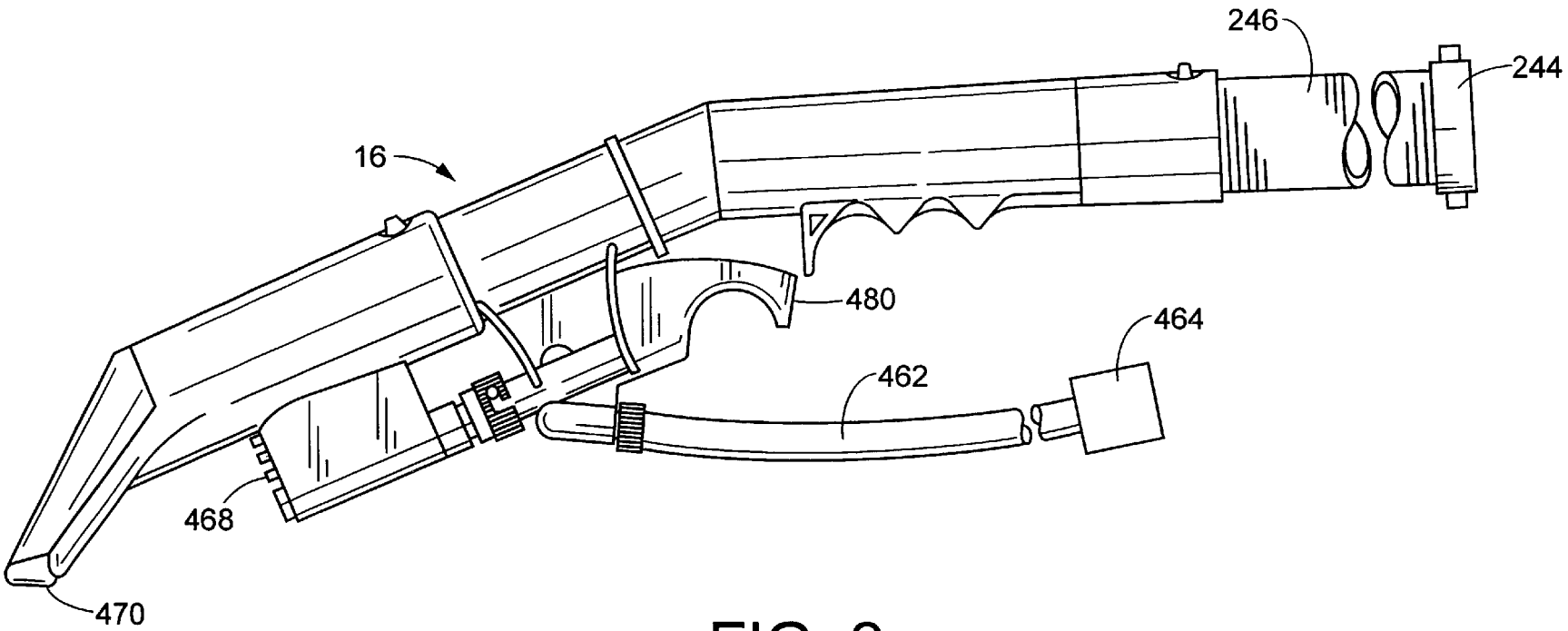
FIG. 2, is a side elevational view of a hand held accessory tool for above floor cleaning according to the present invention.

A trigger 480, at the remote end of the tool hose 442, is actuated, as required, to allow the cleaning solution, under pressure, to be sprayed through the remote distributor 468, as shown in FIG. 2. The vacuum hose 246 is connected at its remote end to the accessory nozzle 470. The nozzle may have any desired shape for accessing corners of upholstery, stairs, and the like. Also, a brush (not shown) may be provided adjacent the nozzle, if desired. Dirt and cleaning solution are drawn through the accessory nozzle 470 by the suction fan and thereafter drawn into the recovery tank 22 through the upper end of the second suction nozzle flowpath.

As shown in FIG. 16, the opening 240 for the accessory vacuum hose is longitudinally spaced from the recovery tank inlet slot 160. Dirty cleaning fluid and entrained air entering the recovery tank follows the path shown by arrow J. A sloping baffle wall 484, defined by the lower member 212 of the nozzle assembly, beneath the opening 240, intercepts the incoming fluid and begins the separation of cleaning solution from the entrained air. The fluid is deflected upwardly by the baffle wall 484 and is then drawn into the recovery tank inlet slot 160. From there, the incoming fluid follows essentially the same path through the recovery tank and the dewatered air travels into the fan chamber as previously described.

It will be appreciated that since the vacuum hose 246 for the accessory tool is connected to the nozzle assembly 67, rather than to the recovery tank 22 directly, the recovery tank can be removed from the base 10 without first disconnecting the accessory vacuum hose. The nozzle assembly is simply pivoted out of the way, carrying the vacuum hose with it.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the preferred embodiments, the invention is now claimed to be:

1. A carpet extractor of the type which applies a cleaning solution to a surface and vacuums dirty cleaning solution from the surface, the extractor comprising:

a housing;

a directing handle operatively connected to said housing;

a distributor located in said housing for delivering the cleaning solution to a surface to be cleaned;

a pump located in said housing for pumping the cleaning solution to the distributor;

a selectively operable valve located in said housing for selectively interrupting the flow of cleaning solution to the distributor;

a source of suction located in said housing for applying a vacuum to the surface to draw dirty cleaning solution from the floor surface;

a switching assembly for operating the pump, source of suction, and valve, the switching assembly being mounted to the directing handle;

at least one brushroll, rotatably mounted to the housing;

a motor for driving the brushroll, mounted to the housing;

and wherein the switching assembly includes a switch for operating the brushroll motor.

2. The extractor of claim 1, wherein the switching assembly includes:

a first switch for operating the pump and source of suction;

a second switch for operating the valve.

3. The extractor of claim 2, wherein the switching assembly is located adjacent a hand grip of the directing handle and is operable by an operator's hand while it grips the hand grip.

4. A carpet extractor comprising:

a housing;

a directing handle operatively connected to said housing;

a distributor located in said housing for delivering a cleaning solution to a surface to be cleaned;

a pump located in said housing for pumping the cleaning solution to the distributor;

a first valve located in said housing for selectively interrupting the flow of the cleaning solution to the distributor;

a source of suction located in said housing for applying a vacuum to the surface to draw dirty cleaning solution from the floor surface;

a switching assembly for operating the pump, source of suction, and said first valve, the switching assembly being mounted to the directing handle;

a source of the cleaning solution mounted to the directing handle, fluidly connected with the pump;

a second valve for selectively closing the flow of cleaning solution from the source of the cleaning solution to the pump; and wherein the switching assembly includes a switch for operating said second valve.

5. A carpet extractor comprising:

a base housing;

a source of suction located on one of the base housing and the handle;

a brush mounted on the base housing;

a cleaning solution distributor mounted on the base housing;

a directing handle pivotally mounted to the base housing, the directing handle including a hand grip at a distal end thereof, the hand grip comprising:

a first control mounted on the hand grip for selectively actuating the source of suction;

a second control mounted on the hand grip for selectively actuating the cleaning solution distributor;

a third control mounted on the hand grip for selectively actuating the brush, wherein all three of the controls are located such that they can be actuated by the digits of one hand of a user without the user needing to displace that one hand from the hand grip to reach any of the controls.

6. The carpet extractor of claim 5, further including:

a valve for fluidly connecting a source of a cleaning fluid with the cleaning solution distributor; and a fourth control, mounted on the hand grip for selectively actuating the valve.

7. The extractor of claim 6, further comprising a pump located in said housing for pumping the cleaning fluid to the distributor.

8. The extractor of claim 7, further comprising:

a valve for selectively closing the flow of cleaning fluid from the source of the cleaning fluid to the pump.

9. The extractor of claim 7, wherein said first control selectively actuates operation of said pump.

10. The extractor of claim 1, further comprising:

a source of the cleaning solution mounted to the directing handle, fluidly connected with the pump;

a valve for selectively closing the flow of cleaning solution from the source of the cleaning solution to the pump; and wherein the switching assembly includes a switch for operating the cleaning solution valve.

11. The extractor of claim 1, comprising a pair of spaced apart brushrolls rotatably mounted to said housing.

12. The extractor of claim 4, wherein the switching assembly includes:

a first switch for operating the pump and source of suction;

a second switch for operating the first valve.

13. The extractor of claim 4, further including:

at least one brushroll, rotatably mounted to the housing;

a motor for driving the brushroll, mounted to the housing;

and wherein the switching assembly includes a switch for operating the brushroll motor.

14. The extractor of claim 13, wherein the switching assembly is located adjacent a hand grip of the directing handle and is operable by an operator's hand while it grips the hand grip.

15. The extractor of claim 13, comprising a pair of spaced apart brushrolls rotatably mounted to said housing.

16. The extractor of claim 1, further comprising a pair of spaced apart nozzles mounted to said housing.

17. The extractor of claim 4, further comprising a pair of spaced apart nozzles mounted to said housing.

* * * * *